US005522092A

United States Patent [19]

Streb et al.

[11] Patent Number: 5,522,092

[45] Date of Patent: Jun. 4, 1996

[54] CAP WITH SLEEP POSTURE ALARM

[76] Inventors: Ralph F. Streb, 101 Kennebecasis Drive, St. John, New Brunswick, Canada, E2K 2G2; Melville H. Hutchinson, R.R. 1, P.O. Box 214, Picton, Ontario, Canada, K0K 2T0

[21] Appl. No.: 314,793

[22] Filed: Sep. 29, 1994

[51] Int. Cl.[6] ..... A42B 1/24

[52] U.S. Cl. ..... 2/209.13; 340/575

[58] Field of Search ..... 2/209.13, 422; 340/575, 576

[56] References Cited

U.S. PATENT DOCUMENTS

| | | | |
|---|---|---|---|
| 2,754,497 | 7/1956 | Wolpert | 340/575 |
| 3,953,831 | 4/1976 | Estrada | 340/575 |
| 4,272,764 | 6/1981 | Herr et al. | 340/575 |
| 4,875,030 | 10/1989 | Chiu | 340/575 |

*Primary Examiner*—Peter Nerbun

[57] ABSTRACT

A cap with sleep posture alarm comprising a cap adapted for receiving a user's head; alarm circuitry for generating an alarm signal when electrically energized; at least one speaker for transmitting an alarm based upon receipt of an alarm signal; a power source for providing electrical energy to the alarm circuitry; a first switch having an enabled orientation for energizing the alarm circuitry and a disabled orientation for de-energizing the alarm circuitry; and a second switch coupled to the cap and having a biased orientation when tilted forwards and backwards for allowing an alarm signal to be transmitted to the speaker and an unbiased-orientation for preventing such transmission; whereby when the first switch is enabled, and when the second switch is placed in an engaged orientation such as when a user's head falls forwards or backwards when nodding out in sleep, an alarm is transmitted.

1 Claim, 4 Drawing Sheets

CAP WITH SLEEP POSTURE ALARM

BACKGROUND OF THE INVENTION

1. Field of the Invention

The present invention relates to a cap with sleep posture alarm and more particularly pertains to alerting a user who is nodding out in sleep with a cap with sleep posture alarm.

2. Description of the Prior Art

The use of alerting mechanisms is known in the prior art. More specifically, alerting mechanisms heretofore devised and utilized for the purpose of alerting a sleepy person are known to consist basically of familiar, expected and obvious structural configurations, notwithstanding the myriad of designs encompassed by the crowded prior art which have been developed for the fulfillment of countless objectives and requirements.

By way of example, U.S. Pat. No. 3,683,243 to Rockliff discloses electrical hygrometers. U.S. Pat. No. 4,228,806 to Lidow discloses a sleep state inhibitive wake-up alarm. U.S. Pat. No. 4,259,665 to Manning discloses a driver's sleep or fatigue alarm. U.S. Pat. No. 4,875,030 to Chiu discloses a sleep-preventing alarm device. U.S. Pat. No. 5,038,137 to Lloyd discloses a sleep posture monitor and alarm system.

While these devices fulfill their respective, particular objective and requirements, the aforementioned patents do not describe a cap with sleep posture alarm that is wearable by a user and emits an alarm when a user's head falls forwards or backwards when nodding out in sleep.

In this respect, the cap with sleep posture alarm according to the present invention substantially departs from the conventional concepts and designs of the prior art, and in doing so provides an apparatus primarily developed for the purpose of alerting a user who is nodding out in sleep.

Therefore, it can be appreciated that there exists a continuing need for new and improved cap with sleep posture alarm which can be used for alerting a user who is nodding out in sleep. In this regard, the present invention substantially fulfills this need.

SUMMARY OF THE INVENTION

In the view of the foregoing disadvantages inherent in the known types of alerting mechanisms now present in the prior art, the present invention provides an improved cap with sleep posture alarm. As such, the general purpose of the present invention, which will be described subsequently in greater detail, is to provide a new and improved cap with sleep posture alarm and method which has all the advantages of the prior art and none of the disadvantages.

To attain this, the present invention essentially comprises, in combination, a cap having a top wall with an integral front wall, an integral rear wall, and opposed integral side walls extended downwards therefrom to define a hollow interior and an opening adapted for receiving a user's head, the cap further having a brim extended horizontally outwards therefrom at the juncture of the opening with the front wall. A pair of hollow box-shaped housings are included with each secured to a separate side wall of the cap and with each housing having a downwardly positioned grill formed therethrough. A replaceable battery is included and secured within one of the housings for supplying electrical energy. A power cable is included and has an input plug adapted to be coupled with a cigarette lighter of a vehicle for receiving electrical energy therefrom and an output plug for supplying electrical energy. Alarm circuitry is included and disposed within one of the containers for generating an alarm signal when electrically energized. The alarm circuitry is coupleable with the output plug of the power cable for operation in a stationary mode when receiving electrical energy therefrom and coupled to the battery for comparable operation in a portable mode when receiving electrical energy therefrom. A pair of speakers is included with each speaker disposed within a separate housing facing the grill thereof and with each speaker transmitting an audible alarm based upon receipt of an alarm signal. A power switch is included and extended from one of the containers and coupled to the alarm circuitry and with the power switch having an enabled orientation for allowing the alarm circuitry to be energized and a disabled orientation for preventing the alarm from being energized. Lastly, a mercury switch is provided and further includes a dome having a generally concave bottom-wall coupled to the top wall of the cap, a top wall offset above the bottom wall, a peripheral tubular sidewall interconnecting the top bottom wall and top wall to thereby define a hollow interior, a central reservoir formed on the bottom wall within the interior, a front basin and rear basin formed on the bottom wall within the interior with the front basin positioned in association with the front wall of the cap and the rear basin positioned in association with the rear wall of the cap, two pairs of electrically conductive contacts with the first pair disposed within the front basin and the second pair disposed within the rear basin and with the contacts coupled between the alarm circuitry and the speakers, and liquid mercury disposed within the reservoir in an unbiased orientation for preventing transmission of the alarm signal to the speakers and spillable into the front basin in a forwardly biased orientation when the dome is tilted forwards and spillable into the rear basin in a rearwardly biased orientation when the dome is tilted backwards for allowing transmission of the alarm signal to the speakers. When the cap is secured upon a user's head and the power switch is placed in the enabled orientation, and when the mercury switch is placed in the forwardly biased orientation such as when a user's head falls forward while nodding out in sleep, the alarm circuitry transmits the alarm signal and the speakers transmit the audible alarm. When the mercury switch is placed in the rearwardly biased orientation such as when a user's head falls backward while nodding out in sleep, the alarm circuitry again transmits the alarm signal and the speakers again transmit the audible alarm. When the mercury switch is placed in an unbiased orientation such as when a user's head is held at a generally level orientation, the speakers are prevented from receiving the alarm signal.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved cap with sleep posture alarm which has all the advantages of the prior art alerting mechanisms and none of the disadvantages.

It is another object of the present invention to provide a new and improved cap with sleep posture alarm which may be easily and efficiently manufactured and marketed.

It is a further object of the present invention to provide a new and improved cap with sleep posture alarm which is of durable and reliable construction.

An even further object of the present invention is to provide a new and improved cap with sleep posture alarm which is susceptible of a low cost of manufacture with regard to both materials and labor, and which accordingly is then susceptible of low prices of sale to the consuming public, thereby making such a cap with sleep posture alarm economically available to the buying public.

Still yet another object of the present invention is to provide a new and improved cap with sleep posture alarm which provides in the apparatuses and methods of the prior art some of the advantages thereof, while simultaneously overcoming some of the disadvantages normally associated therewith.

Even still another object of the present invention is to provide a new and improved cap with sleep posture alarm for alerting a user who is nodding out in sleep.

Lastly, it is an object of the present invention to provide a new and improved cap with sleep posture alarm comprising a cap adapted for receiving a user's head; alarm circuitry for generating an alarm signal when electrically energized; at least one speaker for transmitting an alarm based upon receipt of an alarm signal; a power source for providing electrical energy to the alarm circuitry; a first switch having an enabled orientation for energizing the alarm circuitry and a disabled orientation for de-energizing the alarm circuitry; and a second switch coupled to the cap and having a biased orientation when tilted forwards and backwards for allowing an alarm signal to be transmitted to the speaker and an unbiased orientation for preventing such transmission; whereby when the first switch is enabled, and when the second switch is placed in an engaged orientation such as when a user's head falls forwards or backwards when nodding out in sleep, an alarm is transmitted.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
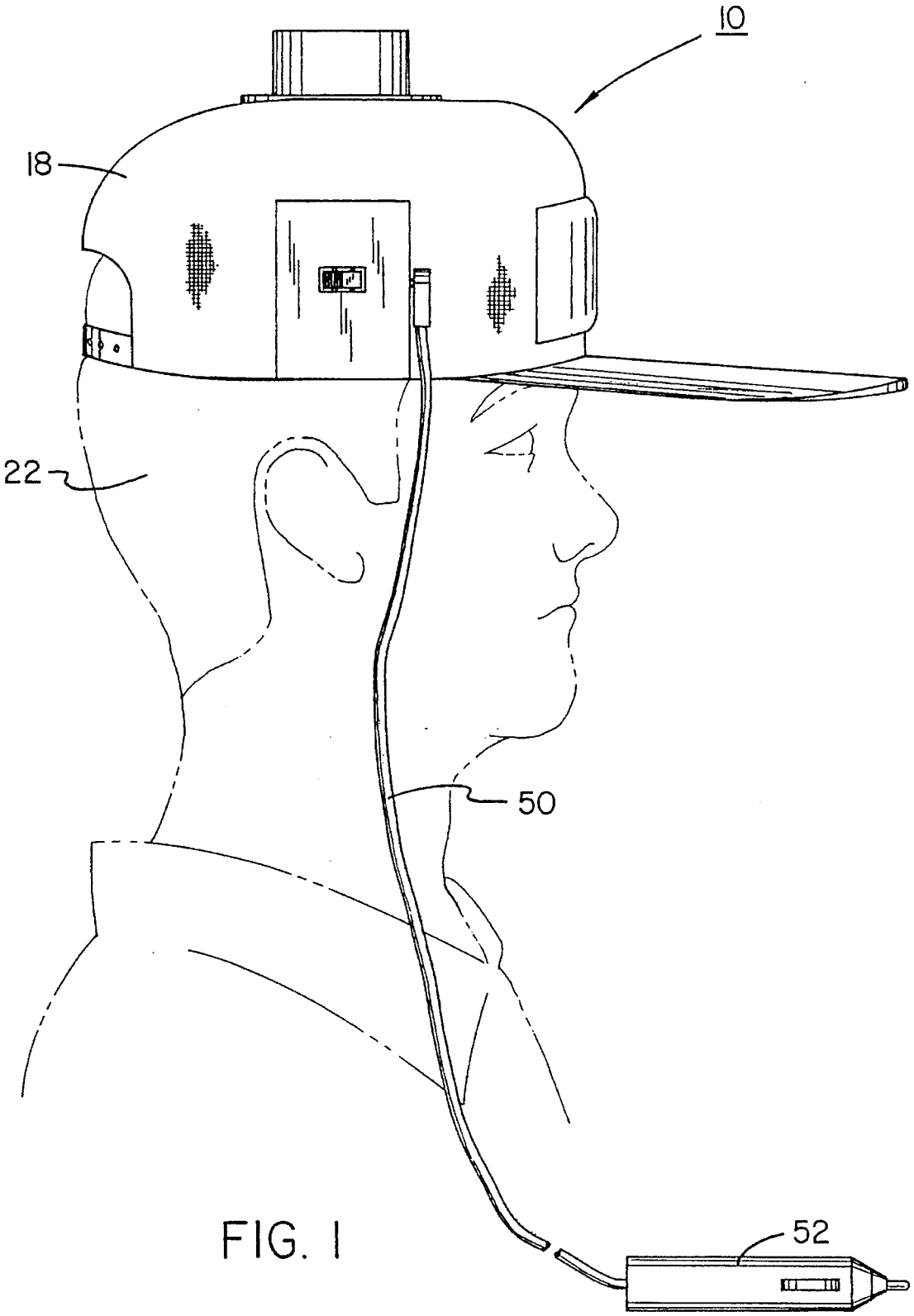
FIG. 1 is a side-elevational view of the preferred embodiment constructed in accordance with the principles of the present invention secured upon the head of a user.
Figure 2:
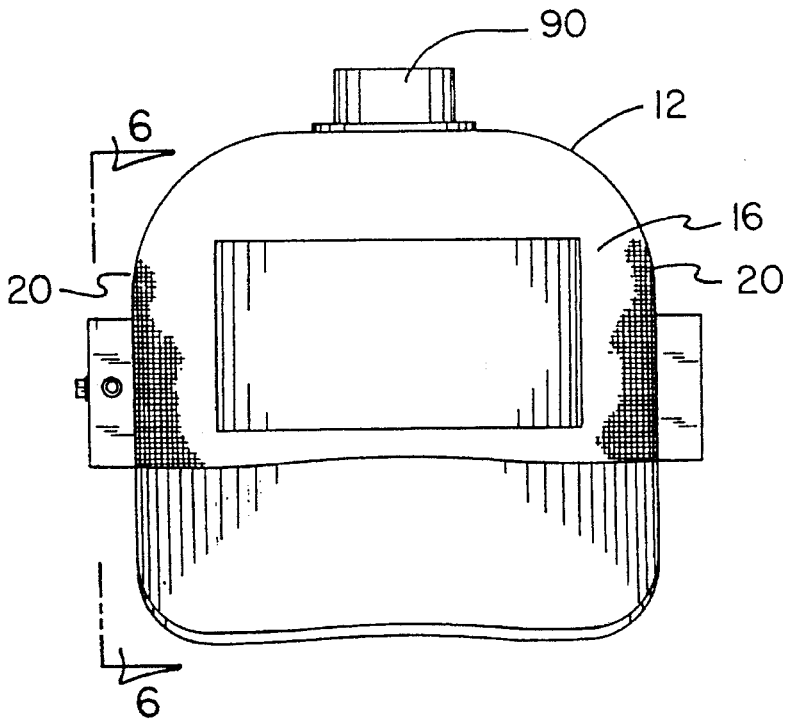
FIG. 2 is yet another side-elevational view of the present invention as viewed from the brim.
Figure 3:
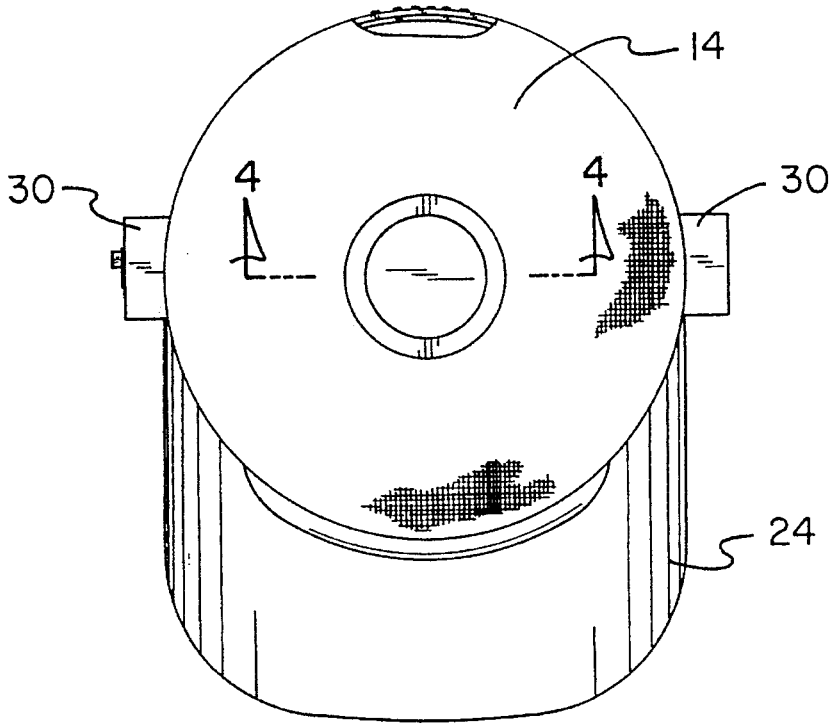
FIG. 3 is a plan view of the present invention depicting the position of the dome on the cap.
Figure 4:
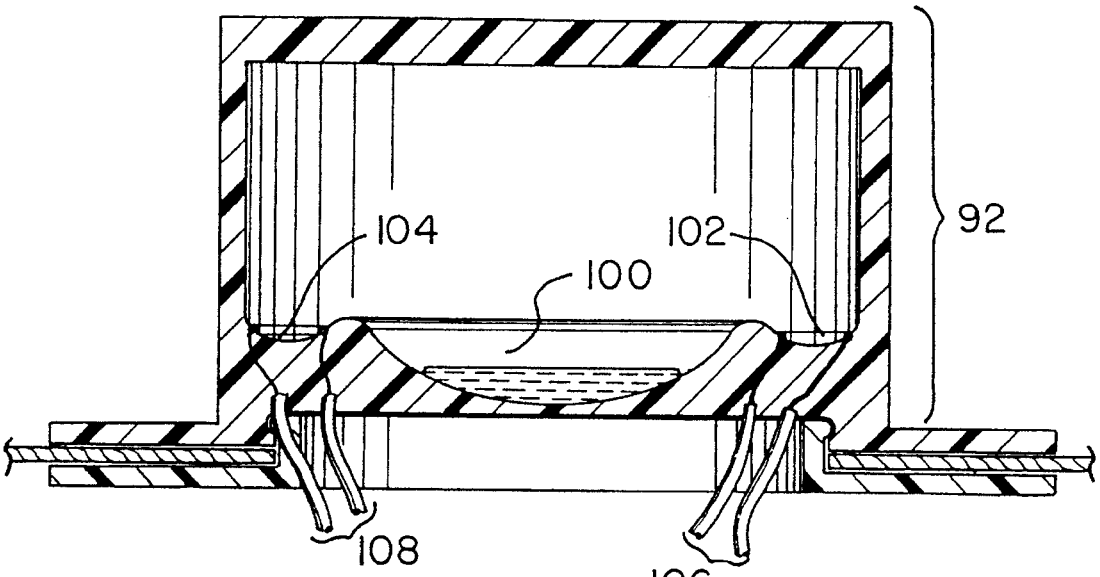
FIG. 4 is a cross-sectional view of the present invention depicting the mercury switch taken along the line 4—4 of FIG. 3. The mercury switch is in an unbiased orientation.
Figure 5:
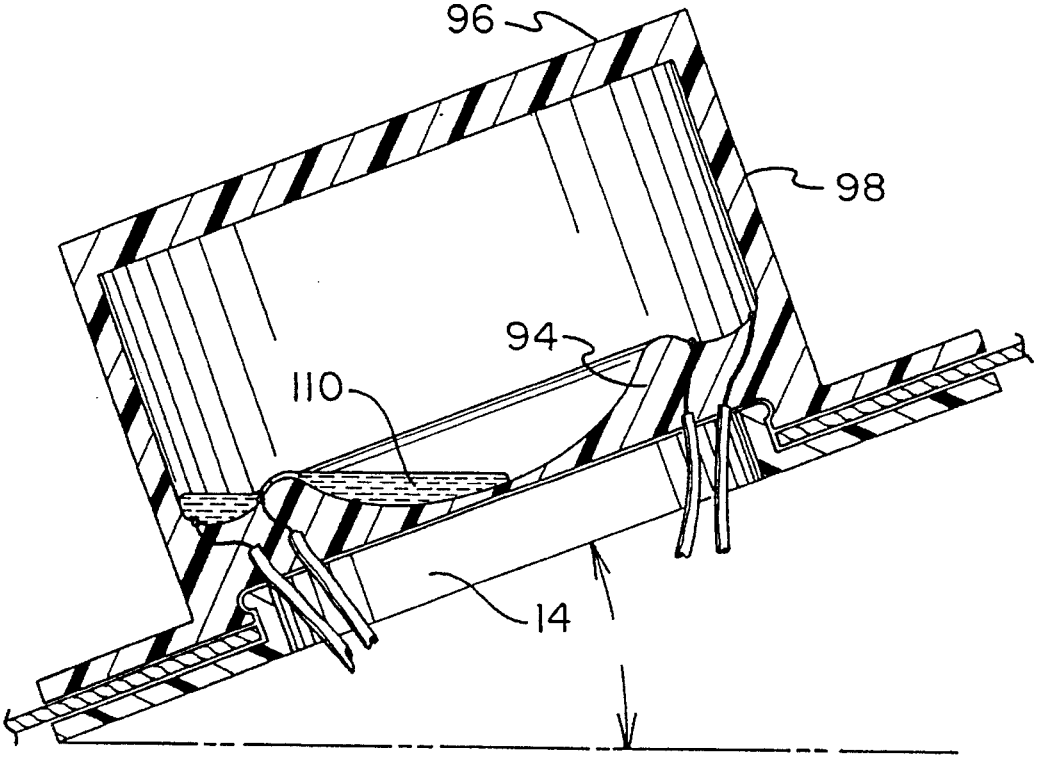
FIG. 5 is a cross-sectional view of the present invention depicting the mercury switch in a rearwardly biased orientation, thereby indicating that a user is nodding out in sleep with his head tilted backwards.
Figure 6:
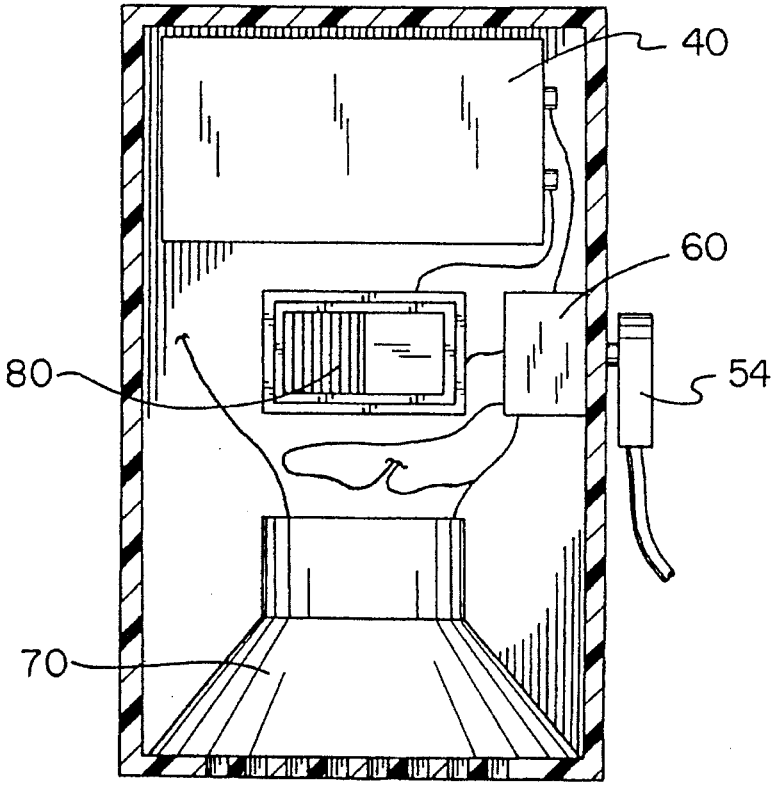
FIG. 6 is a cross-sectional view of one of the housings of the present invention taken along the line 6—6 of FIG. 2.
Figure 7:
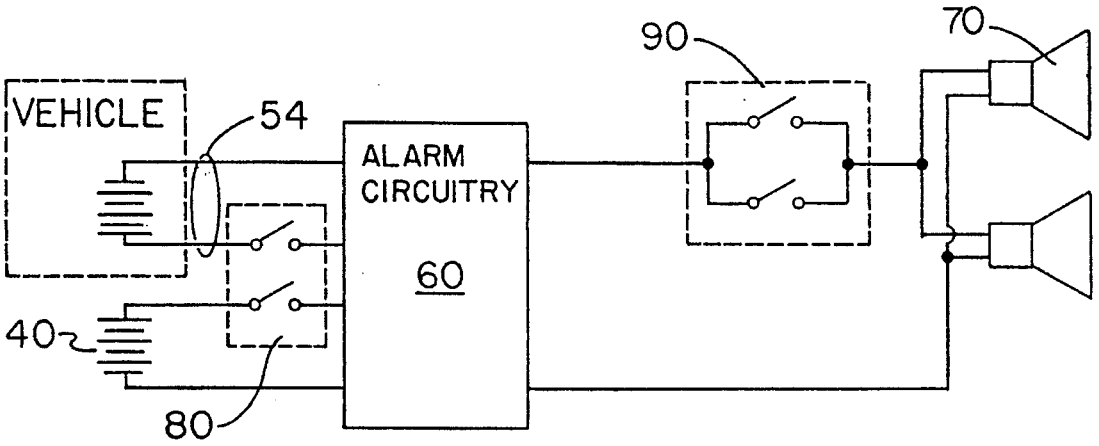
FIG. 7 is a schematic representation of the alarm circuitry of the present invention.

With reference now to the drawings, and in particular, to FIG. 1 thereof, the preferred embodiment of the new and improved cap with sleep posture alarm embodying the principles and concepts of the present invention and generally designated by the reference number 10 will be described.

Specifically, the present invention essentially includes eight major components. The major components are the cap, housings, battery, power cable, alarm circuitry, speakers, power switch, and mercury switch. These components are interrelated to provide the intended function.

More specifically, it will be noted in the various Figures that the first major component is the cap 12. The cap is formed of flexible cloth and is shaped in the form of a baseball cap. The cap has a top wall 14 with an integral front wall 16, an integral rear wall 18, and opposed integral side walls 20 extended downwards therefrom. The walls thus define a hollow interior and an opening. The opening is adapted for receiving a user's head 22 therein. The cap further includes a brim 24 extended horizontally outwards therefrom at the juncture of the opening with the front wall. The brim is used for shielding a user's eyes from direct sunlight.

The second major component is the housings 30. The present invention includes a pair of housings. The housings are hollow, box-shaped, and rigid in structure. Each housing is secured to a separate side wall 20 of the cap such that they are essentially diametrically opposed. Each housing is also positioned such that it is directly over a user's ear. Each housing has a grill 32 formed therethrough. Each grill faces downwards towards a user's ear.

The third major component is the battery 40. It is secured within one of the housings for supplying electrical energy. The battery may be replaced when its electrical energy is expended through an closeable door provided on one of the housings. The battery is conventional in design and commercially available.

The fourth-major component is the power cable 50. The power cable has an input plug 52 and an output plug 54. The input plug is adapted to be coupled with a cigarette lighter of a vehicle for receiving electrical energy therefrom. The output plug supplies electrical energy for use.

The fifth major component is the alarm circuitry 60. The alarm circuitry is disposed within one of the containers. The alarm circuitry is used for generating an alarm signal when electrically energized. The alarm circuitry is coupleable with the output plug 54 of the power cable for operation in a stationary mode when receiving electrical energy therefrom. The alarm circuitry is also coupled to the battery 40 for comparable operation in a portable mode when receiving electrical energy therefrom. The alarm circuitry contains internal sensing components for determining whether power is being supplied from the power cable or from the battery. The alarm circuitry is formed of conventional and commercially available electronic components.

The sixth major component is the speakers 70. The present invention includes a pair of speakers. Each speaker is disposed within a separate housing and positioned therein facing the grill 32 thereof. Each speaker transmits an audible alarm based upon receipt of an alarm signal from the alarm circuitry. This audible alarm is projected downwards through the grill towards a user's ear.

The seventh major component is the power switch 80. The power switch is extended from one of the containers and coupled to the alarm circuitry. The power switch has an enabled orientation for allowing the alarm circuitry to be energized. The power switch also has a disenabled orientation for preventing the alarm circuitry from being energized. The power switch is coupled between the power sources and the alarm circuitry. The power switch may be of the double-pull double-throw type.

The eighth major component is the mercury switch 90. The mercury switch includes a plastic dome 92 having a generally concave bottom wall 94 coupled to the top wall 14 of the cap, a top wall 96 offset above the bottom wall, and a peripheral tubular side wall 98 interconnecting the top and bottom walls to thereby define a hollow interior. The mercury switch also includes a central reservoir formed on the bottom wall within the interior. A front basin 102 and a rear basin 104 are formed on the bottom wall within the interior. The front basin is positioned in association with the front wall 16 of the cap. The rear basin is positioned in association with the rear wall 18 of the cap. Two pairs of electrically conductive contacts are included. The first pair 106 is disposed within the front basin. The second pair 108 is disposed within the rear basin. The contacts are coupled between the alarm circuitry 60 and the speakers 70. Liquid mercury 110 is disposed within the reservoir in an unbiased orientation. In the unbiased orientation, transmission of the alarm signal to the speakers is prevented. The liquid mercury is spillable into the front basin in a forwardly biased orientation when the dome is tilted forwards. The liquid mercury is also spillable into the rear basin in a rearwardly biased orientation when the dome is tilted backwards. In the forwardly biased orientation and the rearwardly biased orientation, the alarm circuitry is allowed to transmit an alarm signal to the speakers.

When the cap is secured upon a user's head and the power switch is placed in the enabled orientation, the present invention is activated for use. When the mercury switch is placed in the forwardly biased orientation such as when a user's head falls forward while nodding out in sleep, the alarm circuitry transmits the alarm signal and the speakers transmit the audible alarm to alert the user. When the mercury switch is placed in the rearwardly biased orientation such as when a user's head falls backward while nodding out in sleep, the alarm circuitry again transmits the alarm signal and the speakers again transmit the audible alarm for alerting the user. When the mercury switch is placed in an unbiased orientation such as when a user's head is held at a generally level orientation, the speakers are prevented from receiving the alarm signal. Upon being alerted by the audible alarm, a user will thus place his head back into a level orientation. The liquid mercury then drains from the activated basin back into the reservoir to thereby stop the audible alarm.

The present invention is a cap which, when worn on the head while driving, will alert the driver that he is starting to nod out in sleep. The present invention uses a mercury switch with a reservoir for containing the liquid mercury when the head of a user or the cap is relatively level. The mercury in the mercury switch will spill over to thereby activate an alarm when a user's chin rests upon his chest or when his head falls backwards. The present invention is comprised of a baseball cap with a plastic dome at its top. The dome houses in combination with the liquid mercury and contacts therein form a mercury switch. The mercury switch is connected between the alarm circuitry and speakers.

When a user's head is held relatively level, the mercury within the mercury switch will be retained in the reservoir of the dome. However, when a user's head is tilted backwards or forwards, liquid mercury will spill from the reservoir into a basin, thereby activating the signal generation circuitry and generating an alarm from the speakers. The present invention is adapted to generate a buzzer-type alarm. Alternately, a minute current flow could be delivered to a user to thereby cause a slight tingle. Either way, the wearer of the cap will be alerted and snap to attention. The present invention would be especially useful when worn by a driver of a vehicle on an extended trip or a monotonous stretch of road.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention,.to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A cap with sleep posture alarm for alerting a user who is nodding out in sleep comprising, in combination:

a cap having a top wall with an integral front wall, an integral rear wall, and opposed integral side walls extended downwards therefrom to define a hollow interior and an opening adapted for receiving a user's head, the cap further having a brim extended horizontally outwards therefrom at the juncture of the opening with the front wall;

a pair of hollow box-shaped housings each secured to a separate side wall of the cap, each housing having a downwardly positioned grill formed therethrough;

a replaceable battery secured within one of the housings for supplying electrical energy;

a power cable having an input plug adapted to be coupled with a cigarette lighter of a vehicle for receiving electrical energy therefrom and an output plug for supplying electrical energy;

alarm circuitry disposed within one of the containers for generating an alarm signal when electrically energized, the alarm circuitry coupleable with the output plug of the power cable for operation in a stationary mode when receiving electrical energy therefrom and coupled to the battery for comparable operation in a portable mode when receiving electrical energy therefrom;

a pair of speakers with each speaker disposed within a separate housing facing the grill thereof, each speaker transmitting an audible alarm based upon receipt of an alarm signal;

a power switch extended from one of the containers and coupled to the alarm circuitry, the power switch having an enabled orientation for allowing the alarm circuitry to be energized and a disabled orientation for preventing the alarm from being energized; and a mercury switch further comprising a dome having a generally concave bottom wall coupled to the top wall of the cap, a top wall offset above the bottom wall of the dome, a peripheral tubular sidewall interconnecting the bottom wall of the dome and top wall of the dome to thereby define a hollow interior, a central reservoir formed on the bottom wall of the dome within the interior, a front basin and rear basin formed on the bottom wall of the dome within the interior with the front basin positioned in association with the front wall of the cap and the rear basin positioned in association with the rear wall of the cap, two pairs of electrically conductive contacts with the first pair disposed within the front basin and the second pair disposed within the rear basin and with the contacts coupled between the alarm circuitry and the speakers, and liquid mercury disposed within the reservoir in an unbiased orientation for preventing transmission of the alarm signal to the speakers and spillable into the front basin in a forwardly biased orientation when the dome is tilted forwards and spillable into the rear basin in a rearwardly biased orientation when the dome is tilted backwards for allowing transmission of the alarm signal to the speakers; and whereby when the cap is secured upon a user's head and the power switch is placed in the enabled orientation, and when the mercury switch is placed in the forwardly biased orientation such as when a user's head falls forward while nodding out in sleep, the alarm circuitry transmits the alarm signal and the speakers transmit the audible alarm, and when the mercury switch is placed in the rearwardly biased orientation such as when a user's head falls backward while nodding out in sleep, the alarm circuitry again transmits the alarm signal and the speakers again transmit the audible alarm, and when the mercury switch is placed in an unbiased orientation such as when a user's head is held at a generally level orientation, the speakers are prevented from receiving the alarm signal.

* * * * *